US007399046B2

(12) United States Patent
Teshigawara et al.

(10) Patent No.: US 7,399,046 B2
(45) Date of Patent: Jul. 15, 2008

(54) INKJET PRINTING APPARATUS AND INKJET PRINTING APPARATUS CONTROL METHOD

(75) Inventors: Minoru Teshigawara, Yokohama (JP); Kiichiro Takahashi, Yokohama (JP); Tetsuya Edamura, Kawasaki (JP); Akiko Maru, Kawasaki (JP); Yoshiaki Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 11/453,908

(22) Filed: Jun. 16, 2006

(65) Prior Publication Data

US 2006/0290730 A1 Dec. 28, 2006

(30) Foreign Application Priority Data

Jun. 23, 2005 (JP) ..... 2005-183983

(51) Int. Cl.
*B41J 29/38* (2006.01)

(52) U.S. Cl. ..... 347/14; 347/29; 347/30; 347/104

(58) Field of Classification Search ..... 347/14, 347/19, 29, 30, 104, 105, 101
See application file for complete search history.

(56) References Cited

U.S. PATENT DOCUMENTS 6,702,274 B1 * 3/2004 Otsuka ..... 271/10.01
6,863,367 B2 * 3/2005 Hamamoto et al. ..... 347/23

FOREIGN PATENT DOCUMENTS

JP 2000-94659 4/2000

* cited by examiner

*Primary Examiner*—Lamson Nguyen
(74) *Attorney, Agent, or Firm*—Fitzpatrick, Cella, Harper & Scinto

(57) ABSTRACT

An inkjet printing apparatus and method can efficiently feed printing media stored in a media storage unit, while at the same time minimizing the reduction in a printing speed during the ejection recovery operation. The ejection recovery operation is performed during a period extending from the end of printing for a preceding printing medium which is fed first by a feeding unit, to start of printing for a succeeding printing medium. The recovery operation is controlled at this time in accordance with a feeding condition under which the feeding operation performed by the feeding unit is determined.

12 Claims, 10 Drawing Sheets

[EJECTION RECOVERY MODE FOR SEQUENTIAL FEEDING]

| MEDIA_TYPE | HIGH SPEED ⇔ HIGH QUALITY | | |
|---|---|---|---|
| | QUALITY 3 | QUALITY 2 | QUALITY 1 |
| PLAIN PAPER | Mode 1 | Mode 2 | Mode 3 |
| POST CARD | Mode 3 | Mode 3 | Mode 3 |
| PHOTOGRAPHIC SHEET | Mode 3 | Mode 3 | Mode 3 |

[EJECTION RECOVER MODE]

| | Mode 1 | Mode 2 | Mode 3 |
|---|---|---|---|
| DRIVE FREQUENCY [KHz] | 10.0 | 10.0 | 10.0 |
| EJECTED DOTS/nozzle | 80 | 200 | 400 |
| REQUIRED TIME [msec] | 36 | 90 | 180 |

【FEEDING SPEED】

| MEDIA_TYPE | HIGH SPEED ⇔ HIGH QUALITY | | |
|---|---|---|---|
| | QUALITY 3 | QUALITY 2 | QUALITY 1 |
| PLAIN PAPER | 15.00 | 6.33 | 6.33 |
| POST CARD | 6.33 | 6.33 | 6.33 |
| PHOTOGRAPHIC SHEET | 6.33 | 6.33 | 6.33 |

[inch/sec]

FIG.6A

【SETUP OF SEQUENTIAL FEEDING MODE】

| MEDIA_TYPE | HIGH SPEED ⇔ HIGH QUALITY | | |
|---|---|---|---|
| | QUALITY 3 | QUALITY 2 | QUALITY 1 |
| PLAIN PAPER | ON | ON | OFF |
| POST CARD | OFF | OFF | OFF |
| PHOTOGRAPHIC SHEET | OFF | OFF | OFF |

FIG.6B

[EJECTION RECOVERY MODE FOR SEQUENTIAL FEEDING]

| MEDIA_TYPE | HIGH SPEED ⇔ HIGH QUALITY | | |
|---|---|---|---|
| | QUALITY 3 | QUALITY 2 | QUALITY 1 |
| PLAIN PAPER | Mode 1 | Mode 2 | Mode 3 |
| POST CARD | Mode 3 | Mode 3 | Mode 3 |
| PHOTOGRAPHIC SHEET | Mode 3 | Mode 3 | Mode 3 |

FIG.7A

[EJECTION RECOVER MODE]

| | Mode 1 | Mode 2 | Mode 3 |
|---|---|---|---|
| DRIVE FREQUENCY [KHz] | 10.0 | 10.0 | 10.0 |
| EJECTED DOTS/nozzle | 80 | 200 | 400 |
| REQUIRED TIME [msec] | 36 | 90 | 180 |

FIG.7B

INKJET PRINTING APPARATUS AND INKJET PRINTING APPARATUS CONTROL METHOD

BACKGROUND OF THE INVENTION

1. Field of the Invention

The present invention relates to an inkjet printing apparatus that sequentially feeds printing media from a printing media storage unit to a printing head. The present invention particularly relates to an inkjet printing apparatus that enables performance of an ejection recovery process during a period extending from the end of printing for a previously fed printing medium to the start of printing for a succeeding printing medium.

2. Description of the Related Art

In an inkjet printing apparatus, ink supplied by an ink supply source, such as an ink tank, is ejected from the ejection ports of an inkjet printing head, as droplets, to form an image on a printing medium. Therefore, in the inkjet printing head (hereinafter referred to simply as the printing head), a plurality of liquid paths are defined that communicate with individual ports, and a common liquid chamber is formed that communicates with these liquid paths. Since the common liquid chamber is also connected to the ink supply port of the ink tank, ink from the ink tank is supplied to the individual liquid paths via the common liquid chamber. Further, ejection energy generation devices, which generate energy for the ejection of ink, are provided along the respective liquid paths, and when these ejection energy generation devices are driven, based on print data, ink droplets are ejected from the ejection ports. It should be noted that electrothermal conversion devices such as heaters, or electromechanical conversion devices, such as piezoelectric devices, are employed as the ejection energy generation devices. Further, in the specification and claims of the present invention, the portions constituted by the ejection ports and the liquid paths are called nozzles.

With this inkjet printing apparatus, when ink has not been ejected for an extended period of time while the liquid paths, over the same period, are filled with ink, the ink in the liquid paths may become viscous or sticky, causing the amount of ink ejected and the landing accuracy with which the ink is deposited to fluctuate, and an ejection malfunction to occur. Furthermore, if the ink becomes extremely viscous or sticky, clogging may occur and the ejection of ink through the ejection ports may be blocked.

In order to remove these inconveniences occasioned by the use of ink, a unique arrangement, which is not found in other printing apparatuses that do not employ ink, is provided for the inkjet printing apparatus. That is, an ejection recovery system is provided for the inkjet printing apparatus. This ejection recovery system cleans the liquid paths in the printing head and through the face (hereinafter referred to as an ejection port formation face) wherein the ejection ports are formed, and maintains an appropriate ejection function state for the printing head.

As one method employed by the ejection recovery system to effect the recovery of the ejection function, there is a so-called ejection recovery method that provides for the forcible ejection of viscous or sticky ink, through the ejection ports, by the application of a predetermined pressure to the liquid paths, and the subsequent introduction of new ink into the liquid paths. As the ejection recovery method, there are a pressure recovery method for applying pressure to the ink supply system, and a suction recovery method for sucking ink through the ink ejection ports, that together can forcibly ejection and remove viscous or sticky ink. Also available is a wiping recovery method whereby a wiping member is arranged so that it contacts the ejection port formation face, and whereby viscous or sticky ink attached near the ejection ports is removed by moving the wiping member across the ejection port formation face.

However, for all the above described recovery methods available for an inkjet printing apparatus, a comparatively long time is required. Therefore, when one of these recovery methods is employed during a printing or a printing related operation, the period required to complete the printing is increased, and overall, the printing speed is reduced. Therefore, as one method for maintaining the ink in the liquid paths in an appropriate ejection state without the printing speed being greatly deteriorated, a recovery method called a preliminary ejection is also employed. According to this preliminary ejection method, ink that is not directly related to printing is ejected to a predetermined ink receiving member. When this preliminary recovery is performed for ejection ports for which the ejection frequency is low, ink in the liquid paths can be maintained in an appropriate ejection state.

In Japanese Patent Application Laid-open No. 2000-094659, an inkjet printing apparatus is described that includes a mechanism for recovering the ejection function of a printing head during the operation for feeding a printing medium. According to the inkjet printing apparatus described in this publication, the preliminary operation of a printing head is started when the feeding operation is begun or while the feeding operation is being performed, so that for a printing medium, the period from the start of the feeding operation until the start of printing can be reduced. Further, in U.S. Pat. No. 6,702,274 is disclosed a proposal related to an increase in the sheet feeding speed for sequential printing. An inkjet printing apparatus described in this patent can independently drive a feeding mechanism, a sheet conveying mechanism and a carriage mechanism. In the inkjet printing apparatus, information obtained by a paper sensor as well as the length of a printing medium are entered, and one or both of these entries are employed to control the timing of the feeding operation. For example, the timing at which to start the feeding of a succeeding printing medium is determined simply in accordance with the length of the printing medium, irrespective of any information obtained by the paper sensor. Or, after the leading edge of the succeeding printing medium has reached a position to the front of the paper sensor, a decision is made as to whether the trailing edge of the current printing medium has passed the paper sensor, and dependant on the result obtained, a determination is made as to whether the feeding operation should be continued.

As described above, according to the inkjet printing apparatus described in U.S. Pat. No. 6,702,274, the timing for the feeding of a succeeding printing medium can be controlled in accordance with the performance progress for the preceding one, which is being processed, so that a minimum distance, relative to the succeeding printing medium, can be designated. In addition, when differently sized printing media are employed or there is a feeding mechanism error, such as minor slippage, the double feeding of printing media or the deterioration of the search function accuracy will not occur. Therefore, fast sequential feeding can be stably performed during sequential printing, and the printing speed can be increased.

In addition, recently, the sizes of ink droplets that are ejected from printing heads have steadily been reduced, and accordingly, images having higher resolutions and improved image quality are being obtained. As a result, and in direct relation to the reductions in the sizes of the ink droplets, the diameters of the ejection ports in printing heads that are currently being produced have become proportionally smaller, and the ejection recovery process has assumed an extremely important role in the maintenance of a stable ejection state for these printing heads. Thus, for inkjet printing apparatuses generally, the ejection recovery process is most effectively performed by employing a period before the printing of a printing medium has begun.

For example, when a printing operation is to be performed for a first printing medium, a predetermined time period is required for the feeding process, beginning at the start of the feeding operation and continuing until the start of the printing operation. Therefore, the ejection recovery process for the printing head can be performed during this period.

In a case where, sequential printing is performed with a sequential feeding operation, a general type of ink jet printing apparatus as previously mentioned begins to feed a succeeding printing only after the trailing edge of a preceding one has passed the paper sensor. Thus, during the sequential printing operation, a sufficient period is available for the performance of the ejection recovery process before the printing of the succeeding printing medium is started.

According to the inkjet printing apparatus disclosed in Japanese Patent Application Laid-open No. 2000-094659, the ejection recovery process can be performed during the feeding operation; however, an extended period of time is required, lasting from the end of the printing of the preceding printing medium to the start of the printing of the succeeding printing medium. Therefore, when sequential printing is to be performed, since the period for the completion of the entire printing operation is extended, the speed at which the printing is performed must be increased.

On the other hand, when high-speed sequential printing is performed by the inkjet printing apparatus described in U.S. Pat. No. 6,702,274, the period of time for the feeding can be reduced because the distance between the preceding printing medium and the succeeding printing medium is shortened. However, the time margin for the performance of the ejection recovery process is reduced. Therefore, depending on the time required for ejection recovery, the feeding of the succeeding printing medium must be delayed in order to provide an adequate period for the performance of the ejection recovery operation. That is, were the inkjet printing apparatus disclosed in U.S. Pat. No. 6,702,274 or in Japanese Patent Application Laid-open No. 2000-094659 to be employed, the overall printing speed would be reduced.

SUMMARY OF THE INVENTION

The present invention can provide an inkjet printing apparatus and control method that can efficiently feed a printing medium from a media storage unit and can minimize any reduction in printing speed due to the performance of an ejection recovery operation.

To resolve the conventional problems, the present invention has the following configuration.

According to a first aspect of the invention, an inkjet printing apparatus comprises:

a printing head that includes ink ejection nozzles;

a feeding means for sequentially feeding a printing medium from a media storage unit, in which printing media are stored, to a printing position for the printing head;

a recovery means for enabling execution of a plurality of recovery modes to recover an ejection function for the ink ejection nozzles within a period of time extending from the end of printing for a preceding printing medium, which is fed first by the feeding means, to the start of printing for a succeeding printing medium, which is to be fed by the feeding means;

a first setup means for designating one of a plurality of feeding conditions for different speeds at which the printing medium is to be fed;

a second setup means for setting one of the recovery modes performed by the recovery means based on the feeding condition that is designated; and a control means for controlling the feeding means in accordance with the feeding condition that is designated, and for controlling the recovery means based on the recovery mode that is set.

According to a second aspect of the invention, a control method, for an inkjet printing apparatus that includes a printing head, provided with ink ejection nozzles, a feeding means for sequentially feeding a printing medium from a media storage unit in which printing media are stored, to a printing position for the printing head, and a recovery means for enabling the execution of a plurality of recovery is modes to recover an ejection function for the ink ejection nozzles within a period of time extending from the end of printing for a preceding printing medium, which is fed first by the feeding means, to the start of printing for a succeeding printing medium, which is to be fed by the feeding means, comprises:

a first setup step of designating a feeding condition during which the feeding means feeds the printing medium;

a second setup step of employing the feeding condition to set a recovery condition for the recovery means; and a control step of controlling the feeding means in accordance with the designated feeding condition, and of controlling the recovery means based on the recovery mode.

According to the present invention, in accordance with the feeding condition during which the feeding means feeds the printing medium, the appropriate ejection recovery operation can be performed while reducing the unnecessary consumption of ink. Therefore, when an efficient feeding process is to be performed by sequential feeding, the wasteful consumption of ink can be minimized. Therefore, according to the present invention, a rise in the running costs can be prevented, and the throughput can be increased.

The above and other objects, effects, features and advantages of the present invention will become more apparent from the following description of an embodiment thereof taken in conjunction with the accompanying drawings.

BRIEF DESCRIPTION OF THE DRAWINGS

FIG. 6A is a diagram showing an example feeding condition employed by the inkjet printing apparatus of the embodiment, indicating feeding speeds;

FIG. 6B is a diagram showing an example feeding condition employed by the inkjet printing apparatus of the embodiment, indicating the setup states of a sequential feeding mode switch;

FIG. 7A is a diagram showing the setup states of ejection recovery modes in the sequential feeding operation performed in the embodiment;

FIG. 7B is a diagram showing the contents of the individual ejection recovery modes shown in FIG. 7A;

DETAILED DESCRIPTION OF PREFERRED EMBODIMENTS

Figure 1:
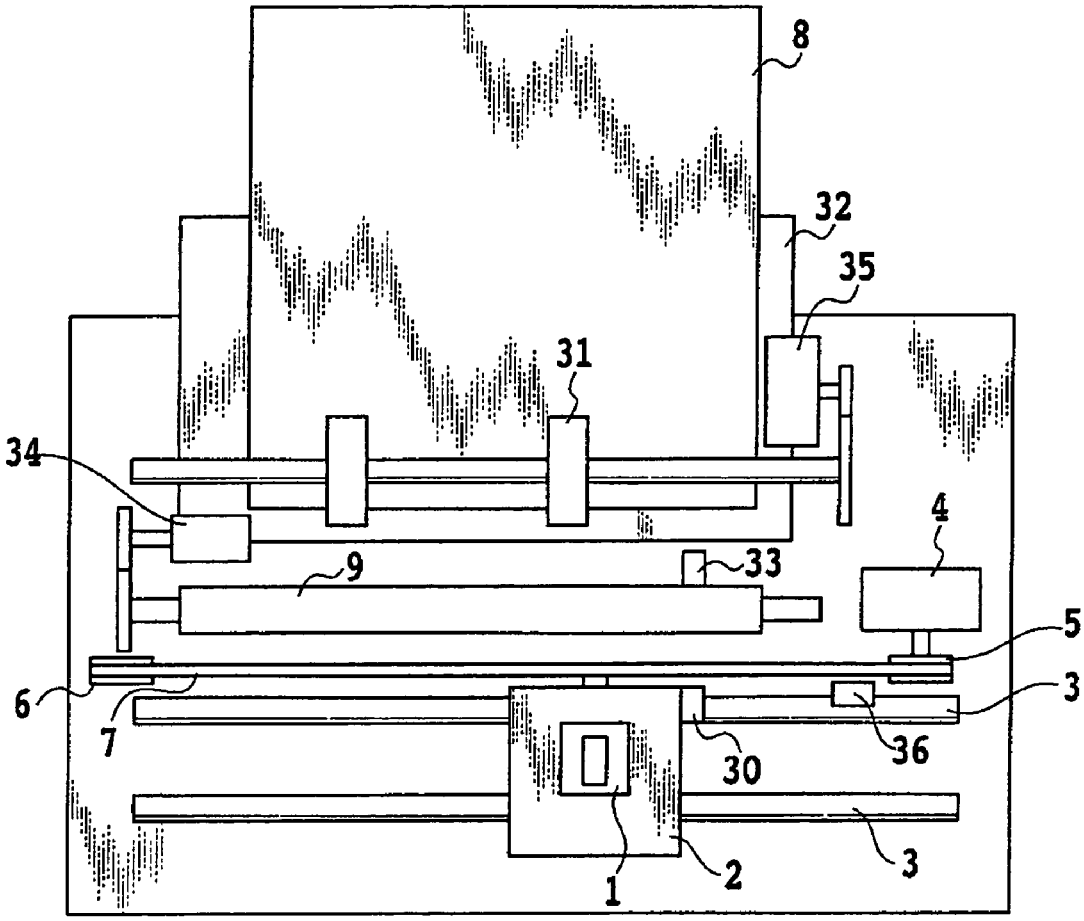
FIG. 1 is a plan view of the overview configuration of an inkjet printing apparatus according to one embodiment of the present invention.

The preferred embodiment of the present invention will now be described in detail while referring to the accompanying drawings. In the drawings, identical or corresponding components are denoted by the same reference numerals.

(Inkjet Printing Apparatus)

FIG. 1 is a plan view of the overview configuration of an inkjet printing apparatus according to the embodiment of the present invention.

In FIG. 1, a head cartridge 1 is mounted, so as to be replaceable, on a carriage 2. The head cartridge 1 includes a printing head unit 13 and an ink tank unit, as well as a connector (not shown) for exchanging, with a control system that will be described later, a signal that drives the printing head unit 13.

The head cartridge 1 is detachably mounted on the carriage 2. A connector holder (an electric connector) (not shown), which transmits a drive signal to the head cartridge 1 via the connector, is provided for the carriage 2. A guide shaft 3 is provided for the main body of the inkjet printing apparatus and is extended in the main scanning direction, and the carriage 2 can be supported by and reciprocally moved along the guide shaft 3. The carriage 2 is driven by a main scanning motor 4 via a drive mechanism that includes a motor pulley 5, a coupled pulley 6 and a timing belt 7. The position and the movement of the carriage 2 are controlled based on detection signals obtained by a linear encoder and a home position sensor 30,which is provided for the carriage 2. When the carriage 2 passes by a shielding plate 36, the home position sensor 30 outputs a predetermined home position detection signal.

As feed rollers 31 are rotated by a feed motor 35, via a gear, a printing medium 8, such as a print paper sheet or a plastic thin sheet, is separately fed, one by one, by an auto sheet feeder (hereinafter referred to as an ASF). Further, when a conveying roller 9 is rotated, the printing medium 8 is conveyed, passing a position (a printing portion) opposite the ejection port face of the head cartridge 1 (the sub-scanning direction). The rotation of the conveying roller 9 is performed, via a gear, by the revolution of an LF motor 34.

In addition, a determination as to whether or not the printing medium 8 has been fed is performed to determine whether or not the printing medium 8 has passed a paper sensor (edge detection means) 33. Furthermore, the printing start position of the printing medium 8 is established by employing, as a reference, the point whereat the printing medium 8 passes the paper sensor 33. The paper sensor 33 is employed to identify the actual location of the trailing edge of the printing medium 8, and the location of the trailing edge of the printing medium 8 is employed as a reference to determine the current printing position.

The reverse face of the printing medium 8 is supported by a platen (not shown), so that the printing section can form a flat printing plane. The head cartridge 1 mounted on the carriage 2 is held so that the ejection port face projects downward, from the carriage 2, parallel to the printing medium 8, between the upstream conveying roller pair and the downstream conveying roller pair.

The head cartridge 1 is an inkjet head cartridge that employs thermal energy to eject ink, and includes an electrothermal conversion element that generates the thermal energy. That is,to perform printing, the printing head unit 13 of the head cartridge 1 converts electric energy, applied to the electrothermal conversion element, into thermal energy, generates ink bubbles using the thermal energy, and ejections ink droplets, through ejection ports, by using the pressure produced by the bubbles.

Figure 2:
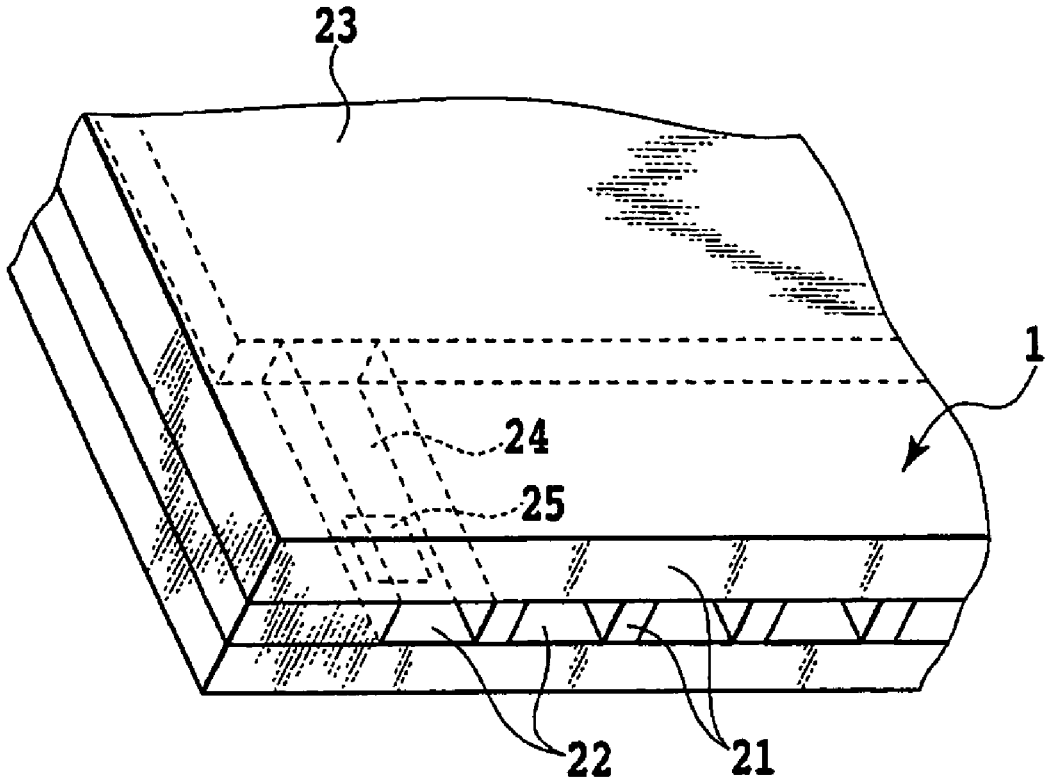
FIG. 2 is a schematic perspective view of one part of the printing head of a head cartridge shown in FIG. 1.

FIG. 2 is a schematic perspective view of part of the printing head unit 13 of the head cartridge 1.

In FIG. 2, at predetermined pitches, a plurality of ejection ports 22 are formed in an ejection port face 21 that faces the printing medium across a predetermined gap (e.g.,about 0.5 to 2.0 millimeters). A plurality of liquid paths 24 communicate with the individual ejection ports 22, and a common liquid chamber communicates with the ends (the internal ends) of the liquid paths. Electrothermal conversion elements (ejection heaters) 25, which generate energy for the ejection of ink, are provided along the inner walls of the individual liquid paths 24. Further, in this embodiment, the printing head unit 13 is mounted on the carriage 2 so that the direction in which the ejection ports 22 are arranged intersects the scanning direction of the carriage 2.

In this head cartridge 1, in accordance with an image signal or an ejection signal, a corresponding electrothermal conversion element (hereinafter also referred to as a "ejection heater") 25 is driven (electrified) and film boiling occurs in the ink in the liquid path 24, and pressure produced by bubbles generated in this manner impels and ejections ink through the ejection port 22.

An overview of the configuration of the control circuit of the inkjet printing apparatus will now be explained while referring to the block diagram in FIG. 3.

Figure 3:
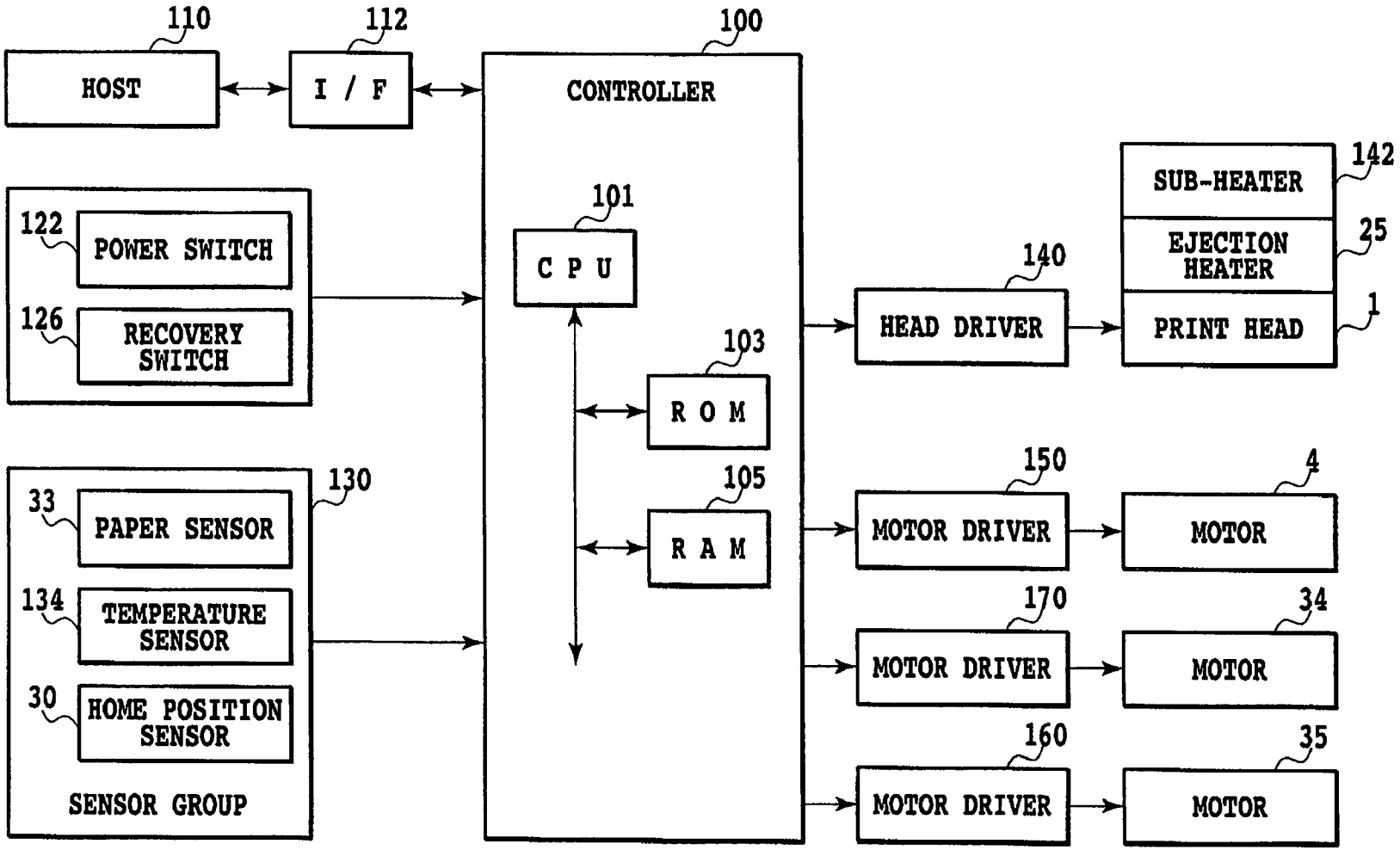
FIG. 3 is a block diagram showing an overview of the configuration of the control circuit of an inkjet printing apparatus according to the embodiment.

In FIG. 3, a controller 100 is a main control unit (control means and recovery condition setup means). The controller 100 includes: a CPU 101, such as a type of microcomputer; a ROM 103, in which a program and a required table and other fixed data are stored; and a RAM 105, in which an area for developing image data and a work area are provided. The controller 100 is connected, via an interface (I/F) 112, to a host 110, which is an image data supply source. The host 110 is constituted by a computer that prepares and processes data, such as image data, related to printing, and that includes a printer driver (means for designating a feeding condition) for entering or setting up data related to printing. It should be noted that the host is not limited to a computer type, and that another type, such as an image reader, can also be employed. Image data and other signals, such as command signals and status signals, are exchanged by the host 110 and the controller 100 via the interface (I/F) 112.

An operation unit 120 is a switching group that accepts an instruction entered by an operator. The switching group includes a power switch 122; a recovery switch 126, for entering an instruction to start suction recovery; and a sequential feed and print switch 127. The sequential feed and print switch 127 is used when printing media 8, stacked on supply tray 32*a* of the ASF 32, are separately fed, one by one, to perform sequential printing. It should be noted that the controller 100 includes a sequential feed switch function for determining whether a succeeding printing medium 40 should be fed before the paper sensor 33 detects the trailing edge of a preceding printing medium 8. In this case, as means for setting the feeding condition, instead of employing the sequential feed and print switch 127, a feed condition may be designated by a host (a printer driver), and a corresponding command may be transmitted to a printing apparatus.

A sensor group 130 is a group of sensors for detecting the state of the printing apparatus. The sensor group 130 includes: home position sensor 30 described above, the paper sensor 33, which detects the presence/absence of a printing medium; and a temperature sensor 134, which is located at an appropriate position to detect an environmental temperature.

A head driver 140 is a driver that drives an ejection heater 2 of a print head 1 in accordance with print data. The head driver 140 includes: a shift register, which arranges print data relative to the location of the ejection heater 2; a latch circuit which latches data at an appropriate timing; a logic circuit element, which starts the ejection heater 2 in synchronization with a drive timing signal; and a timing setup unit, which designates an appropriate drive timing (an ejection timing) to match a dot formation position.

A sub-heater 142 is also provided for the print head 1 to adjust the temperature for stabilizing the ink ejection characteristic. The sub-heater 142 can be mounted on a print head substrate at the same time as the ejection heater 2, and/or can be mounted on the main body of a print head or a head cartridge. In FIG. 2, the sub-heater 142 is not shown.

A main scan motor 4 is a motor that drives the carriage 2, and is to be driven by a motor driver 150. An LF sub-scan motor 34 is a motor that conveys (sub-scans) the printing medium 8, and is to be driven by a motor driver 170. The feed motor 35 is a motor that drives the feed rollers 31 of the ASF 32, and is to be driven by a motor driver 160.

An explanation will now be given for the operation performed by the inkjet printing apparatus of this embodiment, i.e., a processing sequence proceeding from feeding to printing to discharging the print medium.

In this embodiment, in order to start the supply and the feeding of a succeeding printing medium during the printing of a preceding printing medium, the inkjet printing apparatus calculates the latest position of the preceding printing medium and begins the feeding of the succeeding printing medium when the preceding printing medium has arrived at an optimal location. In this case, it is important that the printing of the preceding printing medium be continued, and therefore, the reciprocal movement (the main scanning) of the carriage and the movement of the print head should also be continued.

The feeding process sequence will now be described in proper order.

(Sequential Feeding in Comparison Example)

First, a comparison example, relative to the embodiment, will be explained in order to clearly identify the effects provided by the embodiment. For this comparison example, the conventionally performed sequential feeding operation will be explained while referring to FIGS. 4A to 4E.

Figure 4A:
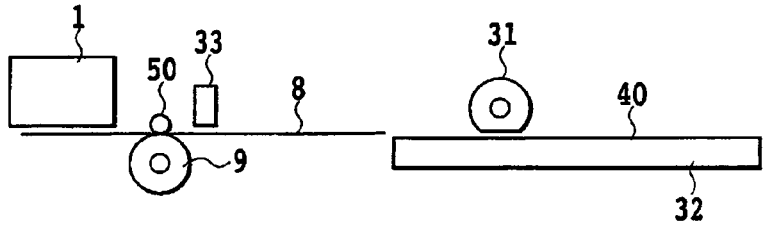
FIGS. 4A to 4E are explanatory diagrams showing the sequential feeding processing performed in a comparison example relative to the embodiment.
Figure 4B:
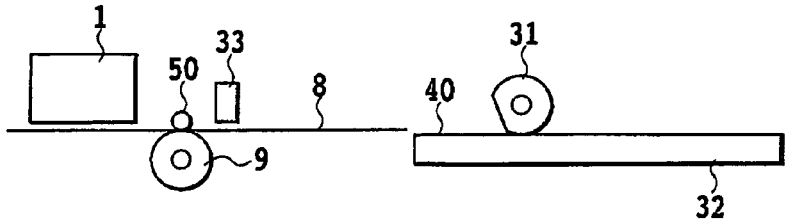
Figure 4C:
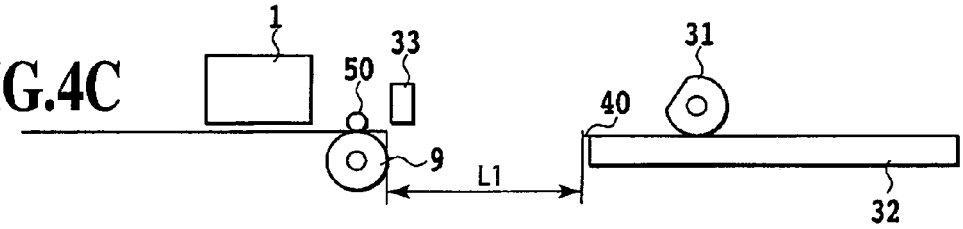
Figure 4D:
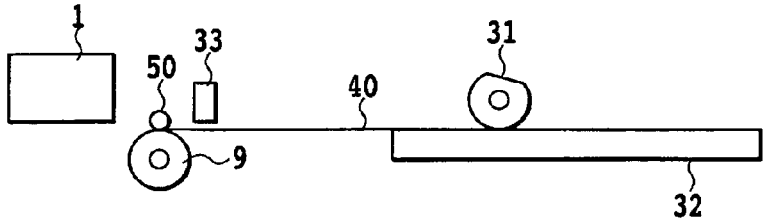
Figure 4E:
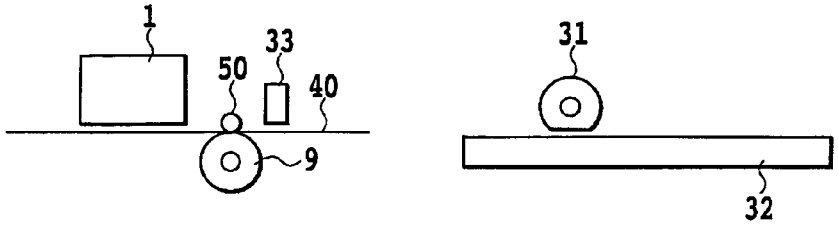

According to the comparison example, the feeding operation advances from the state in FIG. 4A to the state in FIG. 4E. In the state in FIG. 4A, a printing medium 8 that is the first fed is sandwiched between the conveying roller 9 and a pinch roller 50 arranged opposite it and is conveyed in the sub-scanning direction by the rotational force exerted by these rollers. In this state,the presence of the printing medium 8 (a paper present state) is detected by the paper sensor 33.

In the comparison example, before the preceding printing medium 8 has moved past the paper sensor 33, the process for developing print data for a succeeding printing medium 40 is performed. However, the feeding of the succeeding printing medium 40 is delayed until the paper sensor 33 has detected the trailing edge of the preceding printing medium 8. Thus, it is required that after the preceding printing medium 8 has passed the paper sensor 33, there is always an interval L1.

Therefore, in this comparison example, in the state shown in FIG. 4C, the feeding of the succeeding printing medium 40 is begun. At this time, between the preceding printing medium 8 and the succeeding printing medium 40, there is the large distance L1. Then, FIG. 4D shows the state in which the succeeding print medium has passed the paper sensor 33. In this state, the sensor has been detecting the printing medium is present. When the leading edge of the succeeding print medium 40 is detected, the calculation of the printing start position for the succeeding printing medium 40 is begun.

In the state in FIG. 4E, the calculation of the printing start position for the succeeding printing medium 40 has been completed and a conveying roller 9 has been halted, and the head cartridge 1 is to be driven in the main scanning direction (the printing start state).

In the above described feeding process sequence, all the processes, such as the data development process for the succeeding printing medium 40, can be performed prior to the feeding of the printing medium 40, so that the speed of the sequential feeding operation can be increased. Furthermore, since the feeding of the succeeding printing medium 40 is started after the paper sensor 33 has detected the trailing edge of the preceding printing medium 8, neither double feeding nor paper jamming will occur, and the sheet feeding can be stably performed.

However, according to the feeding operation in the comparison example described above, the large interval L1 is defined between the preceding printing medium and the succeeding printing medium. And thus, a long period is required for sequential feeding and the length of the entire printing operation is increased. In order to shorten the interval L1, the paper sensor 33 could be located nearer the feed rollers 31; however, at the feed rollers 31, conveying errors due to slippage on the surface of the printing medium tend to occur. And thus, when there is a long distance between the location at which the printing medium passes the paper sensor 33 and that at which it reaches the conveying roller 9, a large error may occur between the calculated feeding distance and the actual feeding distance, and the printing quality may be deteriorated. Therefore, in this embodiment, the following feeding operation is performed.

(Sequential Feeding Operation for the Embodiment)

FIGS. 5A to 5E are diagrams showing the states for the embodiment wherein sequential feeding is enabled by minimizing the interval between a preceding printing medium 8 and a succeeding printing medium 40. In the state in FIG. 5A, printing is being performed for the printing medium 8, which was fed first. In the state in FIG. 5B, the feed rollers 31 are rotated, and the feeding of the succeeding printing medium 40, from the supply tray 32*a* of the ASF 32, is started when it is determined that there is a predesignated, predetermined interval (a minimum interval) L2 between the trailing edge of the preceding printing medium 8 and the leading edge of the succeeding printing medium 40. The location of the trailing edge of the preceding printing medium 8 is calculated, by the CPU 101 of the controller 100, based on previously obtained information concerning the length of the preceding printing medium 8 and the distance the preceding printing medium 8 was conveyed after it passed the paper sensor 33.

Figure 5A:
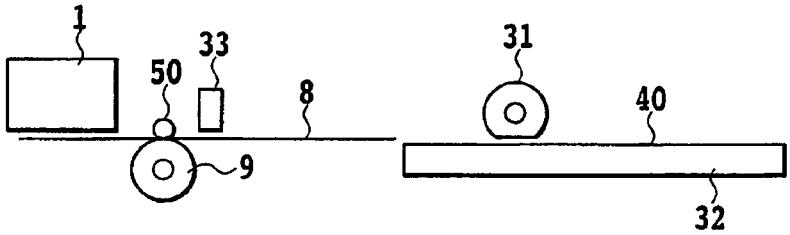
FIGS. 5A to 5E are explanatory diagrams showing the sequential feeding processing performed for the embodiment of the present invention, with a minimal interval between a current printing medium and a succeeding printing medium.
Figure 5B:
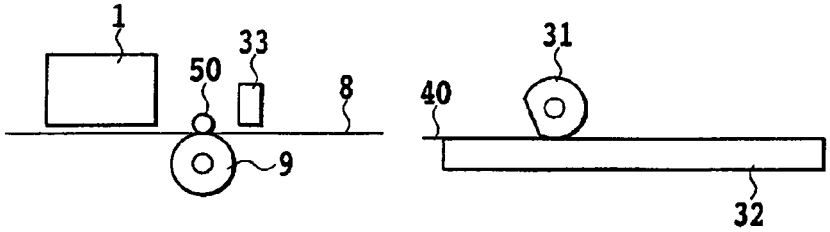
Figure 5C:
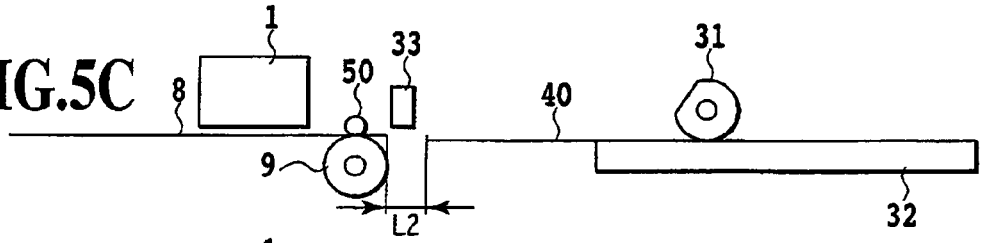

In the state in FIG. 5C, the trailing edge of the printing medium 8, which was fed first, has passed the paper sensor 33, and at this time, no paper is present at this location. Further, in this instance, the succeeding printing medium 40 has advanced to a point immediately before the paper sensor 33, and the location of the leading edge of the succeeding printing medium 40 is calculated based on the distance the feed rollers 31 have revolved. Furthermore, the signal output by the paper sensor 33 is examined to determine whether the trailing edge of the preceding printing medium 8 has passed the paper sensor 33 and the operating state is the paper absent state.

Since the printing operation is performed in the above described manner while the minimum interval L2 is provided between the trailing edge of the preceding printing medium 8 and the succeeding printing medium 40, the succeeding printing medium 40 can be sequentially fed to the conveying roller 9 without the feeding process being halted.

Therefore, during the sequential feeding operation, fast feeding is enabled while the minimum interval L2 is maintained, without any problems, such as double feeding, occurring. In addition, the printing start position for the succeeding printing medium 40 can be accurately controlled during the printing operation.

Figure 5D:
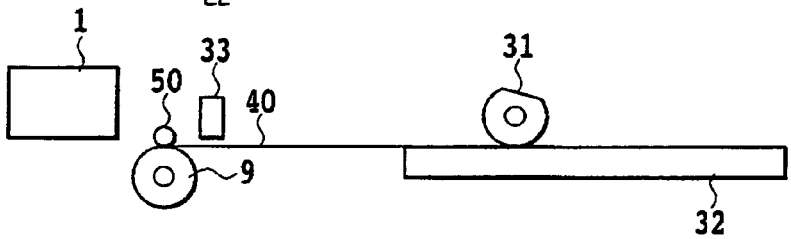
Figure 5E:
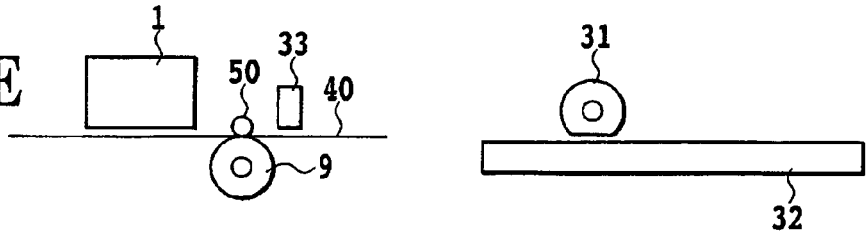

In the state in FIG. 5D, the preceding printing medium 8 is discharged (not shown), and the succeeding printing medium 40 is conveyed to the position of the conveying roller 9. In the state in FIG. 5E, the feeding of the succeeding printing medium 40 has been completed, and the printing can be started.

(Example Application of the Sequential Feeding Operation in this Embodiment)

A general inkjet printing apparatus can perform a plurality of printing modes, including a fast printing mode and a high quality image printing mode, in accordance with a printing condition related to the type of printing medium or the number of printing paths. In this embodiment, an optimal feeding condition is designated in accordance with the printing medium type and the printing mode.

For example, for a printing medium, such as a photographic sheet used for printing a photographic image, on which an ink acceptance layer is deposited, the surface is easily marked by the feed rollers 31 of the ASF 32 when their rotational speed is high. Therefore, the feeding speed is changed depending on the printing medium type.

Further, in a specific high image quality printing mode, the amount of ink ejected onto the printing medium is increased, so that a greater amount of mist-like ink droplets do not reach the paper surface and are attached to the ejection port face. In order to remove the ink droplets attached to the ejection port face, the maintenance process is required each time a sheet is discharged. Therefore, in this case, during sequential printing, as shown in FIGS. 4A to 4E, the large interval L1 is consistently maintained between the preceding printing medium and the succeeding printing medium that are fed.

FIGS. 6A and 6B are diagrams showing example feeding conditions for the inkjet printing apparatus of this embodiment.

In FIG. 6A, feeding speeds are shown that are to be designated in accordance with a combination(a printing condition) of a type of a printing medium and the printing quality of an image to be formed. In FIG. 6B, the ON and OFF states of the sequential feed setup switch are shown that are designated in accordance with the combination of a type of printing medium and a printing quality. According to the inkjet printing apparatus of this embodiment, three printing modes (quality 1, quality 2 and quality 3) for providing fast printing to high quality printing are allocated for the individual printing media.

In FIG. 6A, a feeding speed of 15.00 [inch/sec] is allocated for the quality 3 mode, during which plain paper is employed, and the printing speed is the highest. While a feeding speed of 6.33 [inch/sec] is allocated for quality land quality 2 modes. In FIG. 6B, when sequential printing is to be performed using plain paper, the sequential feed setup switch is set to ON in the quality 3 and quality 2 modes, and to OFF in quality 1 mode. And information concerning the printing medium type and the quality is additionally provided for print data to be transmitted to the inkjet printing apparatus. In accordance with this information, the operation of the feeding mechanism, for the inkjet printing apparatus, and of the mechanism for the printing is determined. In this embodiment, the succeeding printing medium 40 is to be fed a distance such that its leading edge reaches a point 15 mm before the paper sensor 33.

In this embodiment, different ejection recovery conditions are allocated for individual feeding conditions, so that the ejection recovery process performed during the feeding operation can be optimized for each feeding condition (see FIGS. 7A and 7B).

For example, ejection recovery mode 3 (Mode 3) is allocated for quality 1 mode during which the OFF state is designated for the feed setup switch for plain paper (see FIG. 7A). Therefore, in this case, even during sequential printing, the feeding of the succeeding printing medium is not started until the trailing edge of the current printing medium has passed the paper sensor 33. This process is the same as the feeding operation shown in FIGS. 4A to 4E (initial feeding operation). For the second and following sheets, as well as for the first sheet, the initial feeding operation as shown in FIGS. 4A to 4E is performed. During this process, ejection recovery mode 3 is also set. During the ejection recovery process performed at this time, the drive frequency is 10 [KHz], 400 dots are ejected from one nozzle, and a processing period of 180 [msec] is required. Of course, this ejection recovery condition should be changed in accordance with the type of inkjet printing apparatus and printing head, and the ink and the ink droplet size. Furthermore, for an inkjet printing apparatus, there may be a limitation such that ink cannot be ejected at the same time through all the nozzles, due to the limited capacity of a power source, or that multiple ink colors must be ejected from corresponding printing heads. Also in this embodiment, nozzles that eject ink at the same time are limited. Therefore, the ejection recovery condition must be designated while taking these limitations into consideration.

The feeding speed is identical for quality 2 and quality 1 modes. However, for printing plain paper in the quality 2 mode, since the sequential feed setup switch is set to the ON state, there is only a short time interval from the end of the printing of the preceding printing medium (plain paper) 8 to the start of printing of the succeeding printing medium (plain paper) 40. In addition, since the feeding speed is higher for the quality 3 mode than for the others, the timing for the printing start for the succeeding printing medium (plain paper) 40 is shorter. It should be noted that the time interval is directly related to the non-ejection period for the printing head. Therefore, it is preferable that the ejection recovery process during the feeding operation be performed under a different condition and in accordance with the time interval. Specifically, the number of dots to be ejected during the ejection recovery process is optimized while taking the non-ejection period into account. For example, it is preferable that a smaller number of dots are ejected for ejection recovery when the time interval for the feeding of the succeeding printing medium is short.

In all the modes allocated for photographic sheets and postcards, the state of the sequential feed setup switch is set to OFF. Therefore, in this case, even for sequential feeding, the feeding of a succeeding printing medium is not started until the trailing edge of the preceding printing medium has passed the paper sensor 33. Therefore, the initial feeding operation is performed for the second and following sheets, as well as for the first sheet, and the ejection recovery condition Mode 3 is employed.

As described above, according to this embodiment, the ejection recover conditions, such as the frequency, the number of dots ejected and the required processing time, are designated for the ejection recovery operation in accordance with the feeding conditions, such as the sequential/non-sequential feeding operation and the feeding speed. Thus, both an increase in the feeding operation speed and optimization of the ejection recovery operation time can be obtained. Therefore, a stable printing operation can be performed without the printing speed being degraded. In addition, the amount of ink consumed during the ejection recovery process, which is not directly related to the printing operation, can be reduced, and the running costs can also be reduced.

Figure 8:
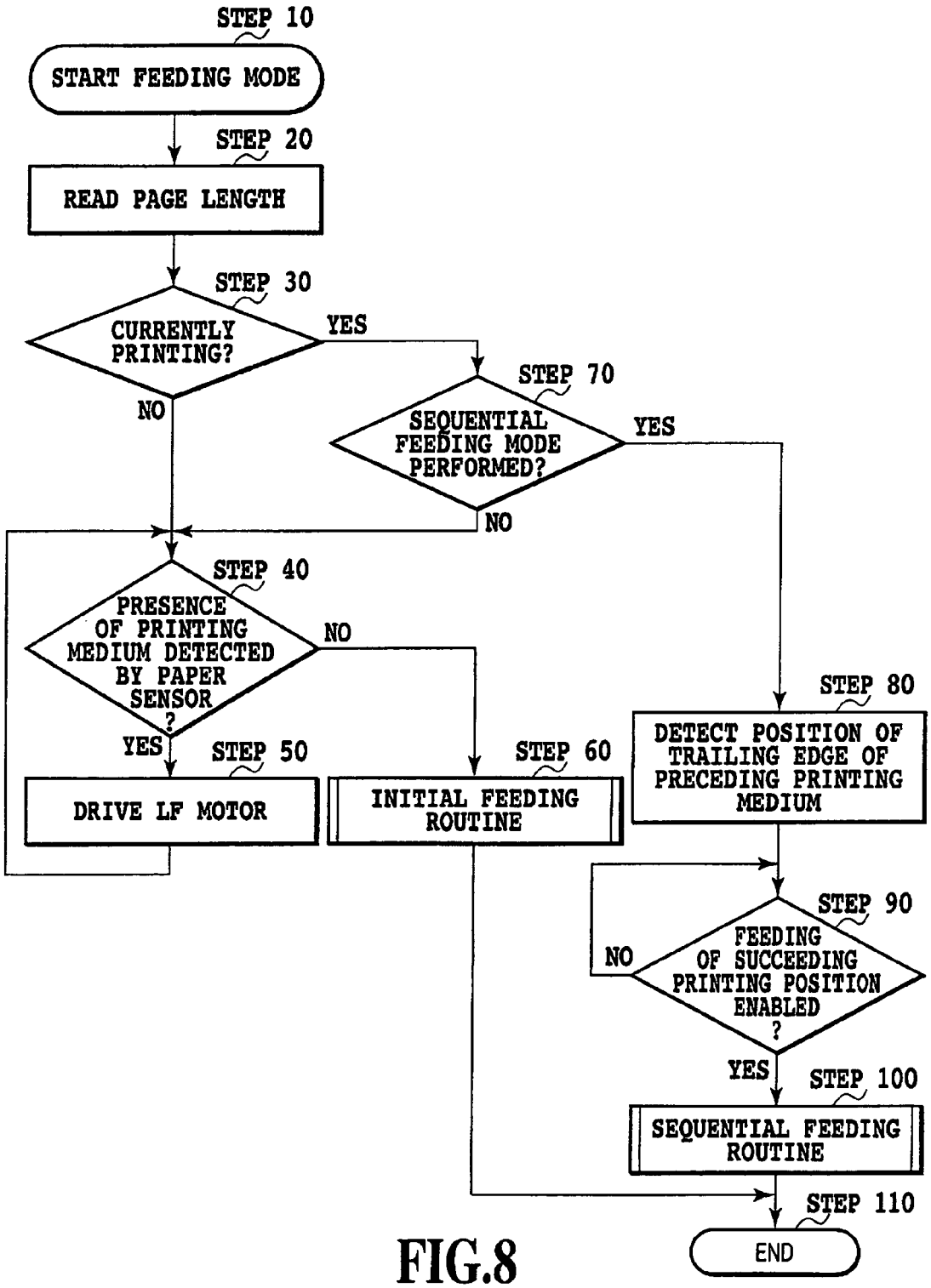
FIG. 8 is a flowchart showing the processing, such as the feeding operation, performed in the embodiment.

The feeding operation and the ejection recovery operation performed in this embodiment will now be described while referring to the flowchart in FIG. 8.

First, at Step 10, the feeding mode is begun by receiving a feeding instruction, and at Step 20, length information for a printing medium to be fed is obtained. In this embodiment, information (page length information) related to the length of a printing medium is obtained from information concerning the setup of a printing medium that is included with print information transmitted by the printer driver of the host computer, and the following operation is to be performed based on the page length information. Instead of being obtained from information related to the setup of a printing medium, the page length information may also be obtained from other information, in which the length of a printing medium is specified, such as information concerning the size, the shape or the type of a paper cassette, or information concerning the width of a printing medium.

At Step 30, a check is performed to determine whether a printing medium that was fed first is currently being printed. When the printing medium 8 is not being printed, at step 40, the paper sensor 33 is employed to determine whether the printing medium 8 is still present in the printing area. When the printing medium 8 is still present in the printing area, at Step 50, the LF motor 34 is activated and discharges the printing medium 8. After the discharging has been completed, at Step 60, program control advances to the initial feeding routine, which is a routine for feeding the first sheet. When the feeding has been completed, program control advances to Step 110, whereat the feeding mode is ended and the actual printing is started.

When it is determined at Step 30 that the printing medium 8 is being printed, program control advances to Step 70. Then, information concerning the printing medium type and the printing quality, which is additionally provided for print data, is employed to determine whether the sequential feeding mode should be performed. When it is determined that the sequential feeding mode should not be performed, at Step 40 the paper sensor 33 is employed to determine whether the printing medium 8 is still present in the printing area. When the printing medium 8 is still present in the printing area, at Step 50, the LF motor 34 is driven to discharge the printing medium 8. Then, when the discharging has been completed, at Step 60, the initial feeding routine (see FIG. 9) is initiated to perform a feeding operation and an ejection recovery process that will be described later. Thereafter, program control advances to Step 110, whereat the feeding mode is ended, and the printing for the succeeding printing medium is started.

When it is determined at Step 70 that the sequential feeding mode should be performed, at Step 80 the position of the trailing edge of the current printing medium 8 is calculated. At Step 90, the timing at which the ASF 32 starts the feeding of the succeeding printing medium 40 is determined by referring to the location obtained for the trailing edge of the current printing medium 8. When it is determined that the timing for the feeding has been reached, the sequential feeding routine (see FIG. 10) at Step 100 is initiated to perform the sequential feeding and the ejection recovery process, which will be described in detail. Thereafter, program control advances to Step 110 and the feeding mode is terminated.

Figure 9:
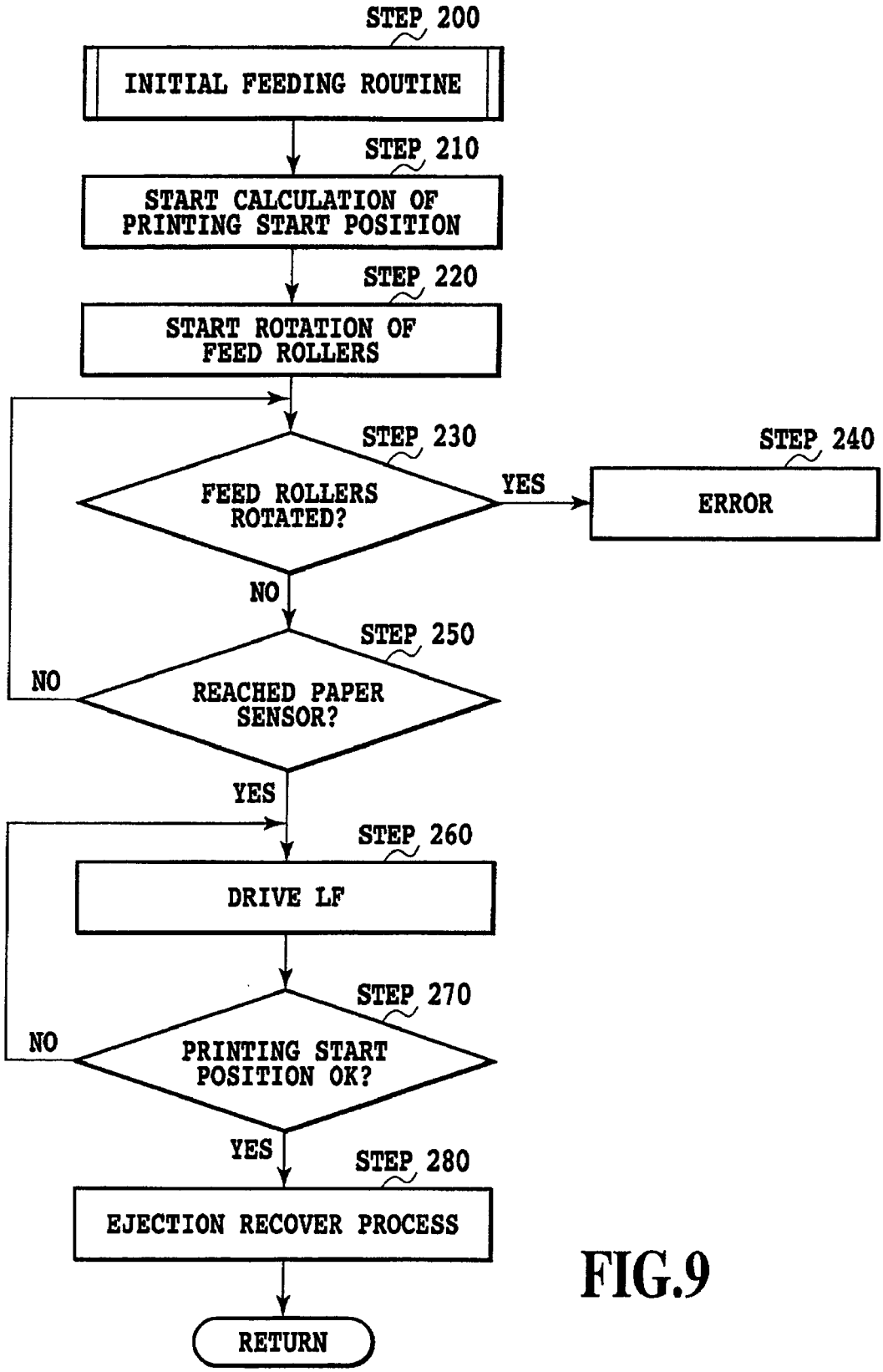
FIG. 9 is a detailed flowchart showing an initial feeding routine shown in FIG. 8.

The initial feeding routine will now be explained while referring to FIG. 9.

When the initial feeding routine is initiated at Step 200, at Step 210, calculation of the printing start position for a printing medium to be fed is begun. Then, at Step 220, the rotation of the feeding rollers 31 at the ASF 32 is begun. Generally, in the case of a serial printer, when printing is started, a printing medium is intermittently conveyed in the sub-scanning direction by the rotation of the LF motor 34. During an intermittent conveying operation, when pressure is applied to the printing medium by the feed rollers 31, the pressure imposes a load and the conveying accuracy is deteriorated. Therefore, semi-circular rollers are frequently employed as the feed rollers 31. Further, the feeding operation is so controlled that it is completed and halted when the feed rollers 31 have made one revolution.

At Step 220, an instruction is issued to start the rotation of the feed rollers 31, and at Step 230, a check is performed to determine whether the feed rollers 31 have made one revolution. At the time of the feeding start, the feed rollers 31 naturally have not yet made one revolution, and program control advances to Step 250, whereat the printing medium has reached the paper sensor 33. When the feed rollers 31 have made one revolution before the printing medium has reached the paper sensor 33, it is assumed that there has been slippage of the printing medium and that a feeding failure has occurred, or that originally no printing media were are present in the ASF 32. Therefore, in this case, program control is shifted to Step 240, and an error message is displayed.

When it is determined at Step 250 that the printing medium has reached the paper sensor 33, rotation of the is feed rollers 31 is continued until one revolution has been completed. When one revolution has been completed, the feed rollers 31 are stopped and the feeding from the ASF 32 is halted. Program control then advances to Step 260, and the rotation of the conveying roller 9 is started. At this time, when the paper sensor 33 detects the presence of the printing medium, the distance the printing medium is to be fed is calculated, and the conveying roller 9 is driven until the printing start position is reached. Then, at Step 280, the ejection recovery process is performed under a predetermined condition, and the initial feeding routine is thereafter terminated.

Figure 10:
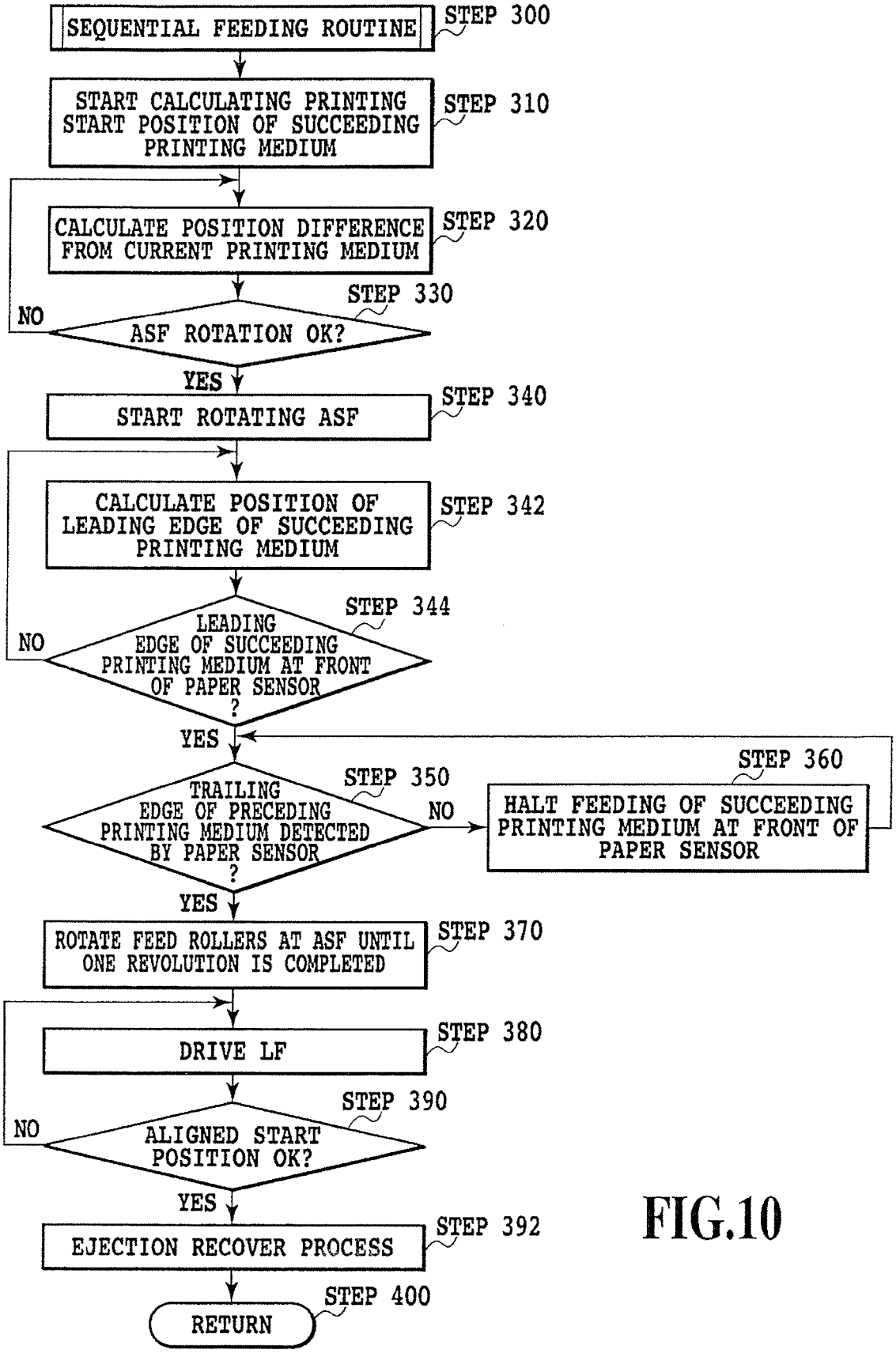
FIG. 10 is a detailed flowchart showing a sequential feeding routine shown in FIG. 8.

The sequential feeding routine will now be described while referring to FIG. 10.

The sequential feeding routine is started at Step 300, and at Step 310, calculation of the printing start position for the succeeding printing medium 40 is begun. Then, at Step 320, the position of the trailing edge of the preceding printing medium 8 is calculated by employing information for the position of the leading edge of the preceding printing medium 8 and printing medium length information that has previously been obtained. Then, a difference between the position of the trailing edge of the preceding printing medium 8 and the position of the leading edge of the succeeding printing medium 40 is calculated, and is employed as a position difference (an interval) between the two edge positions. Thereafter, at Step 330, the position difference information is employed to determine whether feeding of the succeeding printing medium 40 can be started by rotating the feed rollers 31 of the ASF 32.

The position difference information maybe represented by a positive value or a negative value. A positive value is defined as a state within which there is no overlapping, and a negative value is defined as a state within which there is overlapping. That is, whether or not the feed rollers 31 can be rotated is determined and this depends on whether a condition is satisfied or not wherein the current printing medium 8 has passed from under the feed rollers 31 and it is established can be separated from the succeeding printing medium 40. Further, in this embodiment, the interval between the trailing edge of the current printing medium 8 and the leading edge of the succeeding printing medium 40 is defined as position information. However, the rotation of the feed rollers 31 may also be controlled based on information concerning the distance between the trailing edge of the preceding printing medium 8 and the feed rollers 31.

When rotation of the feed rollers 31 of the ASF 32 is started at Step 340, at Step 342, the position of the leading edge of the succeeding printing medium 40 is calculated, and the obtained position is employed to determine whether the leading edge of the printing medium 40 has reached a position to the front of the paper sensor 33 (Step 344). The processes at Steps 320 and 340 are repeated until it is determined that the leading edge of the succeeding printing medium 40 has reached the position to the front of the paper sensor 33.

When it is determined at Step 344 that the leading edge of the succeeding printing medium 40 has reached the position to the front of the paper sensor 33, at Step 350, a check is performed to determine whether the trailing edge of the preceding printing medium 8 has passed the paper sensor 33, i.e., whether the state of the paper sensor 33 is the paper absent state.

When the paper absent state has not been established, at Step 360, the feeding of the succeeding printing medium 40 is halted. In this case, it is assumed that the preceding printing medium 8 and the succeeding printing medium 40 have been fed while overlapped, or that these two media have been fed with almost no intervening interval. Therefore, the feeding of the succeeding printing medium 40 is temporarily halted, and the preceding printing medium is independently conveyed by the conveying roller 9, which is a sub-scanning mechanism. Thereafter, at a specific time, the paper sensor 33 detects the paper absence state, i.e., detects the trailing edge of the current printing medium 8. At this time, the minimum interval is being maintained between the current printing medium 8 and the succeeding printing medium 40.

Thereafter at Step 370, the operation of the ASF 32 is restarted and the feeding operation is resumed. And at Step 380, the conveying roller 9 is rotated at the same speed as the feeding speed, and conveys the succeeding printing medium 40 in the sub-scanning direction until, at Step 390, a required printing start position is reached (printing start OK). Then, when it is determined that the leading edge of the printing medium has reached the aligned start position, at Step 392, the ejection recovery process is performed in accordance with the recovery condition designated in the above described manner. And at step 400, the sequential feeding routine is terminated.

In this embodiment, at Step 360, the feeding operation is halted; however, instead of this, the rotational speed of the feed rollers 31 may be reduced.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2005-183983 filed Jun. 23, 2005, which is hereby incorporated by reference herein.

What is claimed is:

1. An inkjet printing apparatus comprising:

a printing head that includes ink ejection nozzles;

feeding means for sequentially feeding a printing medium from a media storage unit in which printing media are stored to a printing position for the printing head;

recovery means for enabling execution of a plurality of recovery modes to recover an ejection function for the ink ejection nozzles within a period of time extending from the end of printing for a preceding printing medium which is fed first by the feeding means, to the start of printing for a succeeding printing medium, which is to be fed by the feeding means;

first setup means, for designating one of a plurality of feeding conditions for different speeds at which the printing medium is to be fed;

second setup means for setting one of the recovery modes performed by the recovery means based on the feeding condition that is designated; and control means for controlling the feeding means in accordance with the feeding condition that is designated, and for controlling the recovery means based on the recovery mode that is set.

2. An inkjet printing apparatus according to claim 1, wherein, in accordance with the feeding condition, the second setup means changes a period of time required for the recovery mode of the recovery means.

3. An inkjet printing apparatus according to claim 1, wherein the first setup means selectively designates, as the feeding condition, a first feeding mode for which a time interval between the preceding printing medium and the succeeding printing medium is designated that is equal to or longer than a predetermined time, and a second feeding mode for which a time interval between the preceding printing medium and the succeeding printing medium is designated that is shorter than the predetermined time.

4. An inkjet printing apparatus according to claim 3, wherein, in the first feeding mode, the second setup means designates, as a recovery operation condition, a recovery operation period that is equal to or longer than a predetermined period, or in the second feeding mode, designates, as a recovery operation condition, a recovery operation period that is shorter than the predetermined period.

5. An inkjet printing apparatus according to claim 1, wherein edge detection means, for detecting an edge of a printing medium fed by the feeding means, is arranged between the media storage unit and the printing position, and wherein the first setup means selectively designates a first feeding mode, during which feeding of the succeeding printing medium is started after the trailing edge of the current printing medium has been detected by the edge detection means, and a second feeding mode during which feeding of the succeeding printing medium is started before the trailing edge of the preceding printing medium is detected by the edge detection means.

6. An inkjet printing apparatus according to claim 1, wherein the feeding condition for the succeeding printing medium includes at least one drive parameter for a feeding timing produced by the feeding means, a feeding distance and a feeding speed.

7. An inkjet printing apparatus according to claim 1, wherein the first setup means determines the drive parameter for the feeding means based on printing relevant information for the printing operation.

8. An inkjet printing apparatus according to claim 7, wherein the printing relevant information is information added to print data.

9. An inkjet printing apparatus according to claim 7, wherein the printing relevant information includes, at least, either information indicating a printing medium type or information defining a printing quality.

10. An inkjet printing apparatus according to claim 1, wherein, of an ejection frequency, a number of dots to be ejected and a process period required for an ejection recovery operation, at least the process period required is included in the ejection recovery condition.

11. An inkjet printing apparatus according to claim 1, wherein, in accordance with the increase in speed for the feeding of the succeeding printing medium, the second setup means reduces a period required for ejection recovery and how much ink is to be consumed for ejection recovery.

12. A control method, for an inkjet printing apparatus that includes a printing head having ink ejection nozzles, feeding means for sequentially feeding a printing medium from a media storage unit in which printing media are stored to a printing position for the printing head, and recovery means for enabling the execution of a plurality of recovery modes to recover an ejection function for the ink ejection nozzles within a period of time extending from the end of printing for a preceding printing medium which is fed first by the feeding means to the start of printing for a succeeding printing medium which is to be fed by the feeding means, comprising:

a first setup step of designating a feeding condition during which the feeding means feeds the printing medium;

a second setup step of employing the feeding condition to set a recovery condition for the recovery means; and a control step of controlling the feeding means in accordance with the designated feeding condition, and of controlling the recovery means based on the recovery mode.

* * * * *

UNITED STATES PATENT AND TRADEMARK OFFICE

CERTIFICATE OF CORRECTION

PATENT NO. : 7,399,046 B2
APPLICATION NO. : 11/453908
DATED : July 15, 2008
INVENTOR(S) : Teshigawara et al.

It is certified that error appears in the above-identified patent and that said Letters Patent is hereby corrected as shown below:

COLUMN 1:
Line 67, “ejec-” should read --eject--.

COLUMN 2:
Line 1, “tion” should be deleted.
Line 7, “above described” should read --above-described--.
Line 47, “dependent” should read --depending--.

COLUMN 6:
Line 37, “a” should read --an--.
Line 40, “ejections” should read --ejects--.

COLUMN 8:
Line 17, “has” should read --that has--.
Line 26, “above described” should read --above-described--.

COLUMN 9:
Line 15, “above” should read --above- --.

COLUMN 10:
Line 9, “land” should read --1 and--.

COLUMN 12:
Line 48, “is” should be deleted.

COLUMN 13:
Line 11, “maybe” should read --may be--.
Line 19, “an” should read --whether it can--.

UNITED STATES PATENT AND TRADEMARK OFFICE

CERTIFICATE OF CORRECTION

PATENT NO. : 7,399,046 B2
APPLICATION NO. : 11/453908
DATED : July 15, 2008
INVENTOR(S) : Teshigawara et al.

It is certified that error appears in the above-identified patent and that said Letters Patent is hereby corrected as shown below:

COLUMN 14:
Line 1, "above described" should read --above-described--.

Signed and Sealed this

Third Day of March, 2009

JOHN DOLL
*Acting Director of the United States Patent and Trademark Office*